United States Patent [19]

Puerner

[11] Patent Number: 4,944,693

[45] Date of Patent: Jul. 31, 1990

[54] LATCH ARM FOR ELECTRICAL CONNECTOR HOUSING

[75] Inventor: Dean A. Puerner, Maricopa, Ariz.

[73] Assignee: AMP Incorporated, Harrisburg, Pa.

[21] Appl. No.: 433,412

[22] Filed: Nov. 7, 1989

Related U.S. Application Data

[63] Continuation of Ser. No. 387,203, Jul. 28, 1989, abandoned.

[51] Int. Cl.[5] ..... H01R 13/629

[52] U.S. Cl. ..... 439/358; 439/357

[58] Field of Search ..... 439/345, 347, 350, 351, 439/353, 357, 358, 372, 488

[56] References Cited

U.S. PATENT DOCUMENTS

| | | | |
|---|---|---|---|
| 3,475,718 | 10/1969 | Hartz et al. | 439/357 |
| 4,225,206 | 9/1980 | Roman | 439/358 |
| 4,477,022 | 10/1984 | Shuey et al. | 339/59 M |
| 4,640,562 | 2/1987 | Shoemaker | 439/35 D |
| 4,713,021 | 12/1987 | Kobler | 439/272 |
| 4,801,275 | 1/1989 | Ikeda et al. | 439/358 |
| 4,826,443 | 5/1989 | Lockard | 439/101 |
| 4,859,204 | 8/1989 | Daly et al. | 439/424 |
| 4,867,700 | 9/1989 | Kreinberg | 439/422 |

OTHER PUBLICATIONS

U.S. patent appln. Ser. No. 07/341,864, Bennett et al. (drawings & abstract enclosed).

*Primary Examiner*—Eugene F. Desmond
*Assistant Examiner*—Walter G. Hanchuk
*Attorney, Agent, or Firm*—Anton P. Ness

[57] ABSTRACT

A connector housing molded of plastic includes a pair of latch arms along sides thereof which extend forwardly to latch with corresponding latching means of a housing of a mating connector, during connector mating. Each latch arm is joined integrally to the housing sides by hinge joints adapted to permit flexing during deflection of the latch arm during mating and unmating. The hinge joint includes a bight section spaced from the housing side and joined thereto by a pair of parallel upper and lower legs, with the bight section joined to the middle of the latch arm by a cross-shaped rib section. A horizontal rib component of the rib section joins to the bight section midway between the legs and is able to locally elastically deform the bight section inwardly at the rearward edge thereof and outwardly at the forward edge thereof, during latch arm deflection. The latch arms can have rearward portions deflectable inwardly toward the housing sides to enable delatching and unmating.

11 Claims, 2 Drawing Sheets

LATCH ARM FOR ELECTRICAL CONNECTOR HOUSING

REFERENCE TO RELATED APPLICATION

This is a continuation of application Ser. No. 07/387,203 filed July 28, 1989 and now abandoned.

FIELD OF THE INVENTION

This relates to the field of electrical connectors and more particularly to connector housings.

BACKGROUND OF THE INVENTION

Housings for certain electrical connectors are molded from dielectric plastic material and are intended to be secured to mating connector housings when the connectors have been moved together in a mated condition, in which the respective arrays of electrical contacts are mated to complete electrical connections. In some of these connectors, hardware is fastened to the respective housings to secure them together in their mated condition, but it is desirable that the housings have an integral latching means. Integrally molded latch arms are known, in which a pair of latch arms are disposed along opposed sides of the housing of one of the connectors and extend forwardly to latchingly engage corresponding latching surfaces of the housing of the other connector, when the connectors are moved together into a mated condition.

Latch arms used for securing connectors together are known in U.S. Pat. No. 4,867,700 and assigned to the assignee hereof. The latch arms include rearward portions which are deflectable to unlatch the latch arms when it is desired to separate and unmate the connectors, in which case the latch arms can be said to be hingedly joined to the housing. Such latch arms are subjected to stress and torque during mating and unmating of the connectors, and the hinge joint must be rugged and durable to withstand many cycles of mating and unmating, especially taking into consideration that the hinge joint is molded of plastic material which can commonly lose strength over time when worked and subjected to temperature cycling as well.

It is desired to provide a hinge joint for latch arms of connector housings which is designed to resist stress and torque and yet be flexible to allow many cycles of deflection of the latch arm.

SUMMARY OF THE INVENTION

The present invention is a hinge joint for joining a latch arm to an outer surface of a plastic connector housing, with the latch arm extending forwardly from the hinge joint to a latching means at the forward end adapted to latchingly engage a corresponding latching means of a mating connector housing, and a gripping portion extending rearwardly from the hinge joint to an inwardly deflectable portion for delatching the forward latching means for connector unmating, the latch arm commonly used as an opposed pair each on one of the opposed sides of the housing. Each hinge joint defines a vertical hinge axis with the forward arm portion deflectable outwardly away from the respective housing side while riding over a corresponding portion of the mating connector housing forwardly of the respective corresponding latching means thereof just prior to latching, or during delatching. Correspondingly the rearward arm portion is deflectable inwardly about the vertical hinge axis to urge the forward arm portion outwardly; thus the pair of gripping portions of the pair of latch arms can be gripped by a person and urged toward each other to unmate the connectors.

The hinge joint for each latch arm comprises a pair of vertically spaced parallel legs coextending outwardly a short distance from the side surface of the housing to a bight section joined integrally to each leg and spaced outwardly from the housing side; each leg is essentially a thin web having a substantial horizontal forward-/rearward dimension. Extending between and integrally joining the vertical bight section to about the middle of the latch arm spaced outwardly therefrom, is a rib section having at least a horizontal rib component, and preferably having intersecting vertical and horizontal components defining a cross-shaped rib cross-section. The legs allow flexure of the bight section, permitting it to deform slightly about the hinge axis sufficiently to allow deflection of the latch arm for latching and delatching; the horizontal rib component slightly elastically deforms the center of the bight section intermediate the spaced legs.

It is an objective of the present invention to provide an integral hinge joint for each latch arm of a connector housing which is capable of flexure to allow deflection of the latch arm during mating and unmating of the connector with a mating connector.

It is a further objective for such a hinge joint to resist stress and torque and be durable over many cycles of latch arm deflection, allowing many cycles of connector mating and unmating.

It is yet another objective for such a hinge joint to be moldable as an integral portion of a plastic connector housing in a two-draw molding process.

An embodiment of the improved integral flexible hinge joint will now be described with respect to the accompanying drawings.

DETAILED DESCRIPTION OF THE PREFERRED EMBODIMENT

Figures 1, 3:
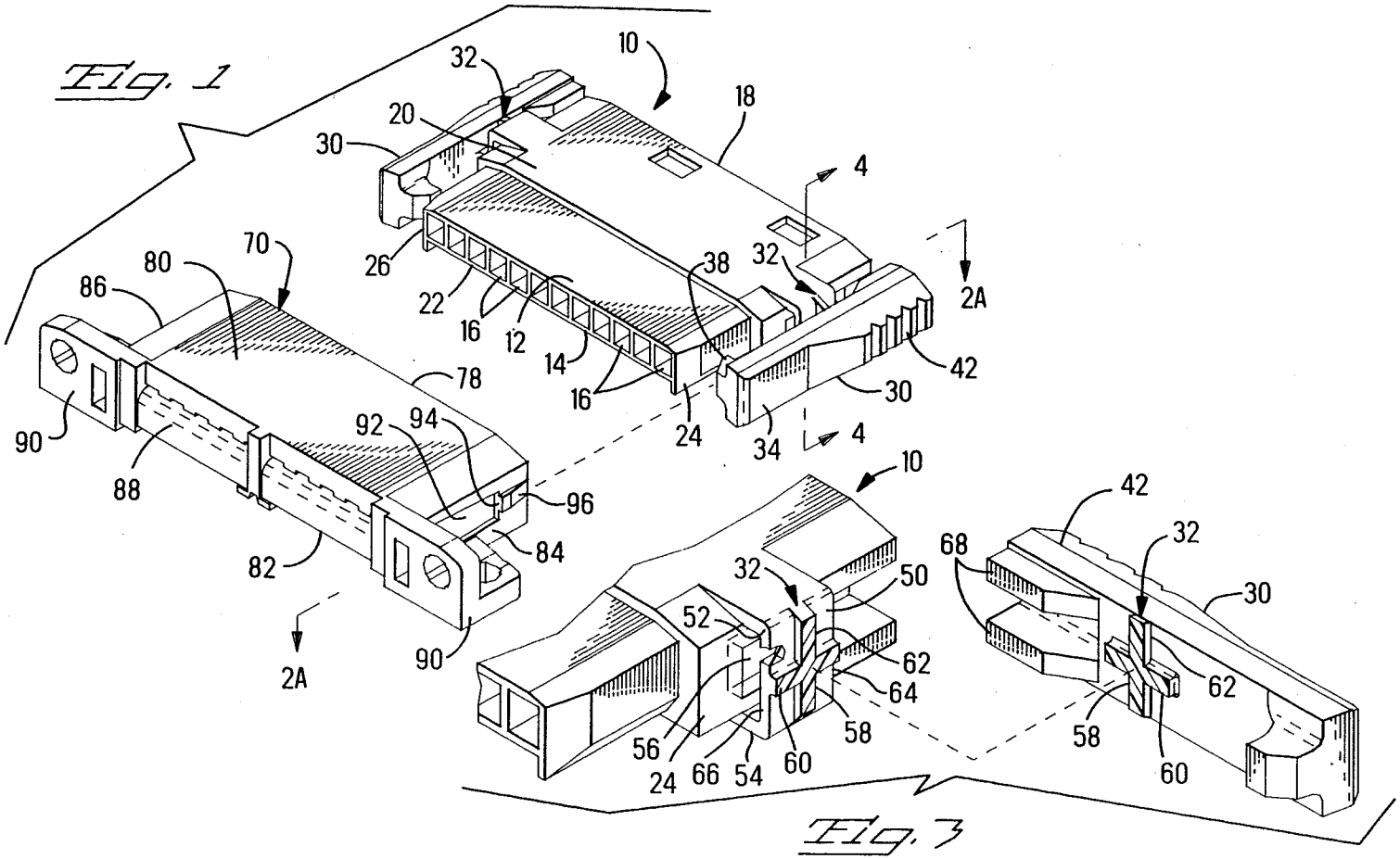
FIG. 1 is a perspective view of a connector housing having a pair of latch arms joined thereto be hinge joints of the present invention, with a mating connector housing spaced therefrom.
FIG. 3 is a part perspective view of a latch arm of FIG. 1 broken away from the housing to expose the hinge joint of the present invention.
Figure 2A:
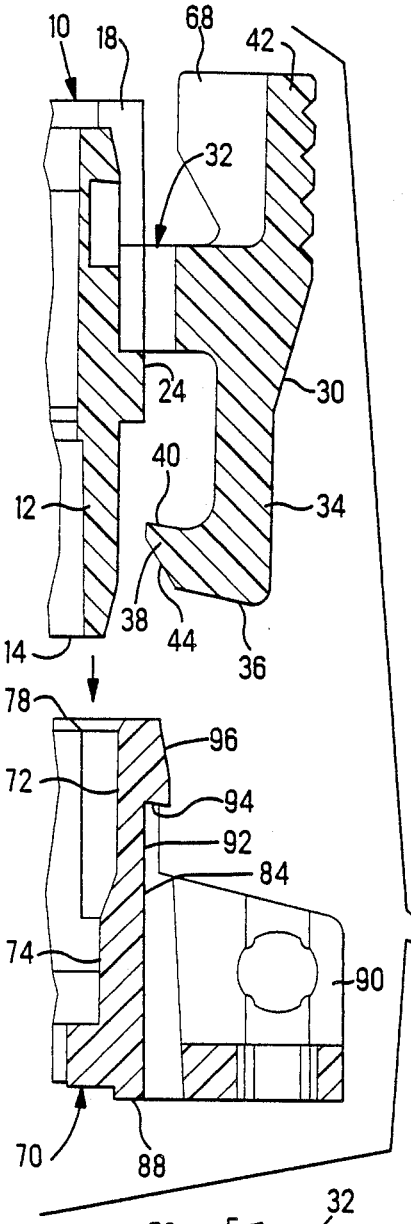
FIGS. 2A and 2B are enlarged longitudinal part section views of the mating connectors of FIG. 1 showing latching of a latch arm during connector mating, with FIG. 2A taken along lines 2A—2A of FIG. 1.
Figure 2B:
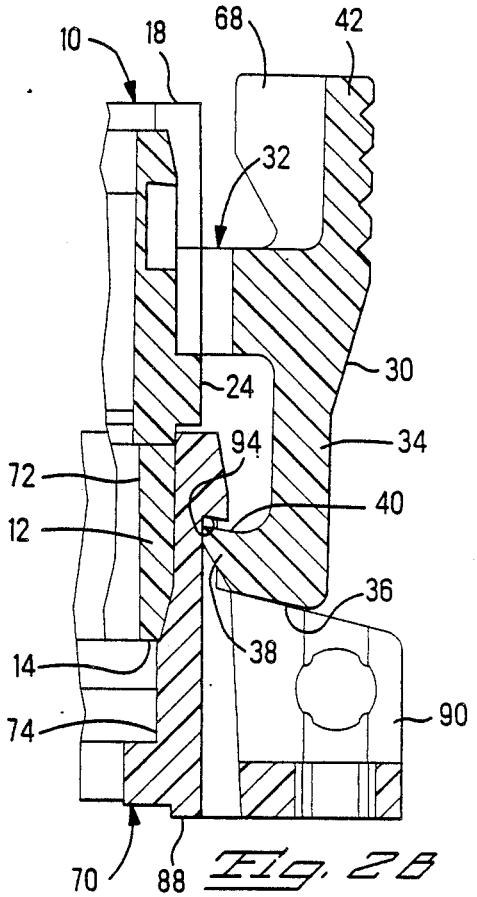

FIGS. 1, 2A and 2B illustrate a pair of dielectric housings 10,70 for a pair of electrical connector assemblies such as those disclosed in U. S. Pat. application Ser. No. 07/386,536 filed July 28, 1989 now U.S. Pat. No. 4,921,442 and assigned to the assignee hereof. Housings 10,70 are molded of plastic material such as glass-filled polyester and are shaped and dimensioned to be matable, with housing 10 having a forward plug portion 12 shaped to be received into a corresponding large cavity 72 of housing 70, so that mating face 14 of housing 10 is disposed proximate the reduced-dimension rearward portion 74 of cavity 72. Shown along mating face 14 are a plurality of passageways 16 within which are housed respective contact sections of terminal means (not shown) secured within housing 10, to mate with corresponding contact means (not shown) secured within housing 70 upon connector mating. Housing 10 has a rear face 18, wide and flat upper and lower outer surfaces 20,22 and low profile sides 24,26. Mating housing 70 has a leading end 78, wide and flat upper and lower outer surfaces 80,82, low profile sides 84,86 and rear face 88; mating housing 70 is also shown having a pair of right-angled mounting flanges 90 for being secured to a printed circuit board (not shown) in either a horizontal or a vertical orientation. Housings 10,70 as shown have a low profile and are especially suitable for use as connectors for connecting a terminated flat power cable to a printed circuit board.

A pair of latch arms 30 are joined integrally to sides 24,26 of housing 10 at respective flexible integral hinge joints 32 located approximately midway along the latch arms. Each latch arm 30 includes a forward portion 34 concluding in a free end 36 having a latching projection 38 extending toward housing sides 24,26 defining a latching surface 40 facing rearwardly and preferably angled slightly outwardly as seen in FIG. 2A. Housing 70 includes a pair of latching recesses 92 along sides 84,86 defining corresponding latching surfaces 94 facing rearwardly and angled slightly inwardly; latching recesses 92 are adapted to receive thereinto latching projections 38. Latch arms 30 further include rearward portions 42 extending rearwardly from hinge joints 32, adapted to be gripped.

During mating of the connectors, latch arms 30 are deflected slightly outwardly as latching projections 38 ride over portions 96 of housing sides 84,86 forwardly of latching recesses 92; upon mating, latching projections 38 enter latching recesses 92 with latching surfaces 40 latching behind corresponding latching surfaces 94. The slight angle of the latching surfaces 40,94 provides resistance to inadvertent delatching during stress and vibration when the connectors are in their mated condition by tending to hold latch arms 30 toward the sides 84,86 of housing 70. The connector-proximate portion of latch arm free ends 36 preferably includes an angled surface portion 44 to engage corresponding portions of leading end 78 of housing 70 and bear thereagainst to initiate deflection of latch arms 30 outwardly. During unmating, rearward latch arm portions 42 are adapted to be urged toward each other, rotating latch arms 30 about their respective hinge joints to delatch latching projections 38 from recesses 92, whereupon housing 10 may be moved rearwardly and away from housing 70.

Figure 4:
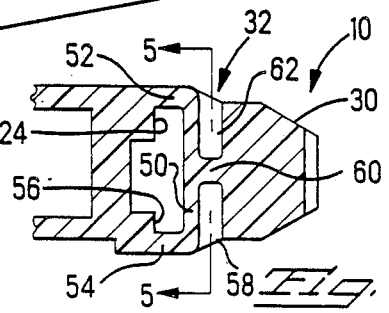
FIGS. 4 and 5 are enlarged cross-section views of the hinge joint of FIG. 3, with FIG. 4 taken along lines 4—4 of FIG. 1 and FIG. 5 taken along lines 5—5 of FIG. 4.
Figure 5:
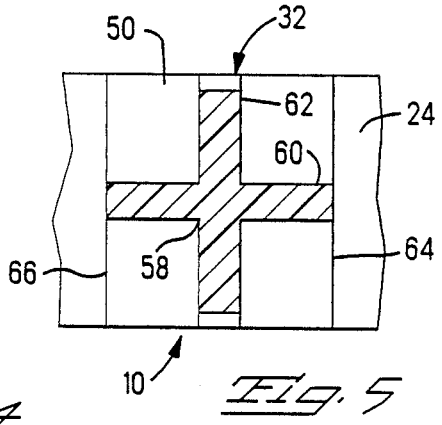

Hinge joint 32 is shown in particular detail in FIGS. 3 to 5 and is capable of flexure during latch arm deflection. Hinge joint 32 includes a bight section 50 joined to housing side 24 by a pair of spaced joints defined by upper and lower legs 52,54 spaced vertically apart and creating a relief area 56 between bight section 50 and housing side 24. Bight section 50 thereby includes a pair of free edges 64,66 and can be said to extend over a recessed portion of housing side 24. Latch arm 30 is jointed to bight section 50 at free edges 64,66 about midway between the pair of spaced joints defined by upper and lower legs 52,54. A rib section 58 at least has a horizontal rib component 60 and preferably also a vertical rib component 62 which intersect to provide rib section 58 with a cross-shaped cross-section. Horizontal rib component 60 is joined to bight section 50 across the outwardly facing surface thereof midway between upper and lower legs 52,54; upon deflection of latch arm 30 in the horizontal plane, horizontal rib component 60 elastically deforms the central portion of bight section 50 into relief area 56 along the first or rearward edge 64 of bight section 50 and away from relief area 56 along the second or forward edge 66 thereof. Vertical rib component 62 provides substantial strength to rib section 58 and bight section 50 to enable long-term resistance to stress and torque. Rearward latch arm portion 42 may preferably be provided with inwardly directed projections 68 adapted to engage housing sides 24,26 to limit the extent of deflection during unmating, as anti-overtress mechanisms.

Those skilled in the art may make modifications to the specific embodiment disclosed hereinabove, which would be within the spirit of the invention and the scope of the claims.

What is claimed is:

1. A hinge joint for joining a deflectable section integrally to a plastic article, comprising a bight section spaced from a surface portion of said plastic article and joined integrally thereto by a pair of leg sections coextending outwardly from said surface portion and spaced apart substantially in parallel to define a relief area therebetween, and a rib section joining said bight section to said deflectable section and having at least a first rib component joined to said bight section substantially parallel to said leg sections and midway therebetween and extending from proximate a first edge of said bight section to proximate a second edge, whereby upon deflection of said deflectable section relative to said article, said bight section is flexible by being adapted to be locally elastically deformed by said first rib component relatively toward said article surface portion at one of said first and second edge portions and relatively away therefrom at the other of said first and second edge portions.

2. A hinge joint as set forth in claim 1 wherein said rib section includes a second rib component perpendicular to said first rib component and joining said deflectable section and said bight section, whereby said rib section has a cross-shaped cross-section.

3. A connector housing molded of plastic material and matable with a corresponding connector housing and having a pair of latch arms on opposite sides thereof each having respective latching projections at forward free ends thereof latchable with corresponding latching means of said corresponding connector housing, each said latch arm joined to a respective said side of said housing at a hinge joint spaced a selected distance rearwardly from said forward free end of said latch arm, each said hinge joint comprising a bight section spaced from said side of said housing and joined integrally thereto by a pair of leg sections coextending outwardly from said side and spaced apart substantially in parallel to define a relief area therebetween, and a rib section joining said bight section to said latch arm and having at least a first rib component joined to said bight section substantially parallel to said leg sections and midway therebetween and extending from proximate a first edge of said bight section to proximate a second edge, whereby upon deflection of said latch arm relative to said housing, said bight section is flexible by being adapted to be locally elastically deformed by said first rib component relatively toward said housing side at one of said first and second edge portions and relatively away therefrom at the other of said first and second edge portions 4. A connector housing as set forth in claim 3 wherein said rib section includes a second rib component perpendicular to said first rib component and joining said latch arm section and said bight section, whereby said rib section has a cross-shaped cross-section.

5. A connector housing as set forth in claim 3 wherein said latch arms include rearward portions extending rearwardly from respective said hinge joints to define a pair of inwardly deflectable latch arm portions enabling delatching and unmating of said connector housing from said corresponding connector housing.

6. A hinge joint for joining a deflectable section integrally to a plastic article, comprising a bight section joined integrally to a surface portion of said plastic article at a pair of spaced joints and extending over a recessed portion of said surface portion between said spaced joints and defining a first free edge and a second free edge spaced from said first free edge, and means jointing said bight section to said deflectable section about midway between said pair of spaced joints, said joining means at least joining said deflectable section to said bight section proximate said first free edge of said bight section and proximate said deflectable section relative to said article, said bight section is flexible by being adapted to be locally elastically deformed by said joining means relatively toward said article surface portion at one of said first and second free edges and relatively away therefrom at the other of said first and second free edges.

7. A hinge joint as set forth in claim 6 wherein said spaced joints comprise respective leg sections extending between said article and said bight section.

8. A hinge joint as set forth in claim 6 wherein said joining means comprises a rib section joining said deflectable section to said first and second free edges.

9. A connector housing molded of plastic material and matable with a corresponding connector housing and having a pair of latch arms on opposite sides thereof each having respective latching projections at forward free ends thereof latchable with corresponding latching means of said corresponding connector housing, each said latch arm joined to a respective said side of said housing at a hinge joint spaced a selected distance rearwardly from said forward free end of said latch arm, each said hinge joint comprising a bight section joined integrally to a respective side of said housing at a pair of spaced joints and extending over a recessed portion of said housing side between said spaced joints and defining a first free edge and a second free edge spaced from said first free edge, and means joining said bight section to said deflectable section about midway between said pair of spaced joints, said joining means at least joining said deflectable section to said bight section proximate said first free edge of said bight section and proximate said second free edge thereof, whereby upon deflection of each said latch arm relative to said article, the respective said bight section is flexible by being adapted to be locally elastically deformed by said joining means relatively toward the respective said housing side at one of said first and second free edges and relatively away therefrom at the other of said first and second free edges.

10. A hinge joint as set forth in claim 9 wherein said spaced joints comprise respective leg sections extending between said housing and a respective said bight section.

11. A hinge joint as set forth in claim 9 wherein said joining means comprises a rib section joining a respective said latch arm to said first and second free edges.

* * * * *

UNITED STATES PATENT OFFICE

CERTIFICATE OF CORRECTION

Patent No. 4,944,693 Dated July 31, 1990

Inventor(s) Dean A. Puerner

It is certified that error appears in the above-identified patent and that said Letters Patent is hereby corrected as shown below:

In the Claims:

Claim 4, Column 5, Line 4 - delete the word "section" after the words "latch arm".

Claim 6, Column 5, Line 19 - the word "jointing" should be --joining--.

Claim 6, Column 5, Line 23 - insert "second free edge thereof, whereby upon deflection of said" after the words "proximate said".

Signed and Sealed this

Third Day of December, 1991

*Attest:*

HARRY F. MANBECK, JR.

*Attesting Officer*

*Commissioner of Patents and Trademarks*